United States Patent [19]

Munroe

[11] Patent Number: 4,836,793

[45] Date of Patent: Jun. 6, 1989

[54] DUPLEX ELECTRICAL RECEPTACLE WITH ONE-PIECE MULTI-FUNCTION GROUNDING STRIP

[75] Inventor: Ronald G. Munroe, Staten Island, N.Y.

[73] Assignee: Eagle Electric Mfg. Co. Inc., Long Island City, N.Y.

[21] Appl. No.: 208,178

[22] Filed: Jun. 17, 1988

[51] Int. Cl.[4] ..... H01R 13/652; H01R 4/38

[52] U.S. Cl. ..... 439/107; 439/106; 439/97; 439/801

[58] Field of Search ..... 439/101, 106, 107, 108, 439/92, 95, 97, 650, 801

[56] References Cited

U.S. PATENT DOCUMENTS 2,399,957 6/1942 Tinnerman ..... 439/801 X 3,835,438 10/1974 Longworth, Jr. ..... 439/97

FOREIGN PATENT DOCUMENTS 0622886 6/1961 Canada ..... 439/801

*Primary Examiner*—Eugene F. Desmond

*Assistant Examiner*—Stephen Zagrobelny

*Attorney, Agent, or Firm*—Kirschstein, Ottinger, Israel & Schiffmiller

[57] ABSTRACT

A one-piece, multi-function, grounding strip is assembled within an electrical receptacle, and includes a screw terminal which is highly resistant to removal of a grounding screw from the strip. The grounding terminal portion of the strip is much reduced in thickness as compared to conventional grounding terminals, and includes a pair of spaced-apart tineman-type single screw threads formed on grounding plates. A support element is sandwiched between the plates to form a combination which is highly resistant to forces tending to strip the grounding screw from the plates.

12 Claims, 2 Drawing Sheets

DUPLEX ELECTRICAL RECEPTACLE WITH ONE-PIECE MULTI-FUNCTION GROUNDING STRIP

BACKGROUND OF THE INVENTION

1. Field of the Invention

This invention generally relates to duplex electrical grounding receptacles and, more particularly, to a one-piece multi-function grounding strip assembled within the receptacle.

2. Description of Related Art

A conventional grounded duplex electrical receptacle has a pair of electrical outlets, each having two power sockets for receiving two power prongs of an electrical plug, and one grounding socket for receiving a grounding prong of the plug. The receptacle is conventionally installed in a wall-mounted electrical junction box to which two power wires and a ground wire are routed from a power supply. Each wire is connected to a respective screw mounted on the receptacle. Each screw is threaded into, and makes electrical contact with, a respective electrically conductive strip located within the receptacle. Thus, a first power strip spans the distance between, and interconnects, associated power sockets of both outlets; a second power strip spans the distance between, and interconnects, other associated power sockets of both outlets; and a grounding strip spans the distance between, and interconnects, associated grounding sockets of both outlets.

A conventional wall plate is mounted over the receptacle. The wall plate, which can be made of metal or plastic, has openings corresponding to the spacing and size of the electrical outlets so that the outlets remain exposed after the wall plate has been mounted over the receptacle. The exposed outlets enable the three-pronged electrical plugs to be inserted into the corresponding sockets of the outlets.

As previously noted, a grounding screw is threaded into the grounding strip. The ground wire at the junction box is exposed at its end and wrapped at least partly underneath the head of the grounding screw to provide a reliable grounding for the receptacle. The grounding screw is subject to external forces, particularly during wiring of the receptacle, which forces tend to pull the grounding screw from its grounding strip. To prevent such removal, the grounding strip according to the prior art was typically made of a metal having a thickness of at least 0.030 in. and extruded to a 1/16 in. long cylinder in order to provide a minimum of two threads at 32 threads per inch, for engaging the grounding screw. Two threads were considered the minimum necessary to withstand expected removal forces when the screw is torqued down on the wire with a rotational force of 14 in.-lbs.

Although the known grounding strips have been generally satisfactory for their intended purposes, they are undesirable in that the relatively large thickness dimension of the grounding strips contribute to high manufacturing costs. Also, they generally are made up of at least two parts: thick metal for the screw terminal, thin metal for the female, male prong contacts, and some means to reliably fasten the two parts.

Another problem with the known grounding strips is that they typically had to be held in position between upper and lower housing parts of the receptacle during assembly therewith. Experience has shown that the grounding strip would sometimes be shifted in position, thereby misaligning the strip and complicating the overall assembly procedure.

SUMMARY OF THE INVENTION

1. Objects of the Invention

It is a general object of this invention to reduce the thickness of a grounding strip without compromising the ability of the grounding screw to reliably resist removal therefrom due to external forces.

It is another object of this invention to reduce the manufacturing costs of grounding strips.

A further object of this invention is to facilitate automatic assembly of the grounding strip within the receptacle.

Still another object of this invention is to provide multiple grounding functions in a one-piece grounding strip, thereby eliminating any connecting interfaces and their inherent resistances resulting from multi-partite construction.

2. Features of the Invention

In keeping with these objects, and others which will become apparent hereinafter, one feature of this invention resides, briefly stated, in a one-piece multi-function grounding strip for assembly within an electrical receptacle of the type mounted in a junction box and covered by a wall plate.

The strip comprises wiper means integral with the strip, and operative for wipingly contacting a ground prong of an electrical plug to be plugged into the receptacle. Advantageously, the wiper means includes a pair of grounding contacts struck out of the strip, and bounding an opening through which the ground prong is inserted in electromechanical wiping contact with the grounding contacts. Each grounding contact is formed with a centrally-located, upwardly-open slot to form a pair of contact faces for each grounding contact. A pair of support ribs is provided on the receptacle, each rib supportably engaging a respective grounding contact in order to reliably resist distortion of the same upon insertion of the ground prong.

The strip also comprises box fastener contact means integral with the strip, and operative for contacting a box fastener, e.g. a threaded screw, employed for mounting the receptacle in the junction box. When the box and its fastener are made of conductive material, the box fastener contact means advantageously grounds the box to the grounding strip.

The strip further comprises wall plate fastener means integral with the strip, and operative for supportably engaging a wall plate fastener operative for mounting the wall plate over the receptacle. The wall plate fastener means is advantageously constituted by a stamped-through single screw thread which threadedly engages a threaded wall plate fastener. When the wall plate and its fastener are constituted of an electrically conductive material, the wall plate fastener means advantageously grounds the wall plate to the grounding strip.

The strip yet further comprises means integral therewith for holding the strip at a predetermined position within the receptacle during assembly. Advantageously, the holding means includes a support post on the receptacle and extending through an aperture formed through the strip. The aperture is bounded by resilient walls which supportably engage the support post. This feature automatically holds the strip in place within the receptacle and facilitates automatic assembly.

In further accordance with this invention, screw terminal means integral with the strip is provided for electrically grounding the same. A pair of spaced-apart electrically conductive grounding plates, each having a stamped-through single screw thread bounding a hole, is formed on the strip. The hole on one plate is aligned on an axis with the hole on the other plate. A grounding screw has a threaded shaft which is received through the aligned holes. The single screw threads threadedly engage the grounding screw at spaced-apart locations and resist any axially-directed forces tending to pull the grounding screw from the plates.

Advantageously, an electrically insulating, generally planar, support element integral with the receptacle is assembled between the grounding plates for engagement therewith. The resultant combination of two grounding plates with the support element sandwiched therebetween, all in mutual contact, renders the screw terminal means highly resistant to removal of the grounding screw. This is accomplished without having to form the strip with a relatively large thickness dimension to accommodate multiple screw threads for threadedly engaging the grounding screw. Due to the thinness of the grounding strip, e.g. on the order of 0.015 in., the single screw threads can be formed by stamping techniques to form a tinamen-type thread.

Still another feature of this invention resides in providing electrically insulating bosses extending into the spacing between the grounding plates and supporting the same from opposite sides thereof. The bosses serve to reinforce the screw terminal means to resist forces tending to remove the grounding screw therefrom.

Not only is the grounding strip, per se, novel, but this invention is also intended to cover an improved electrical receptacle in which such a grounding strip is assembled.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

DETAILED DESCRIPTION OF THE PREFERRED EMBODIMENT

Figure 3:
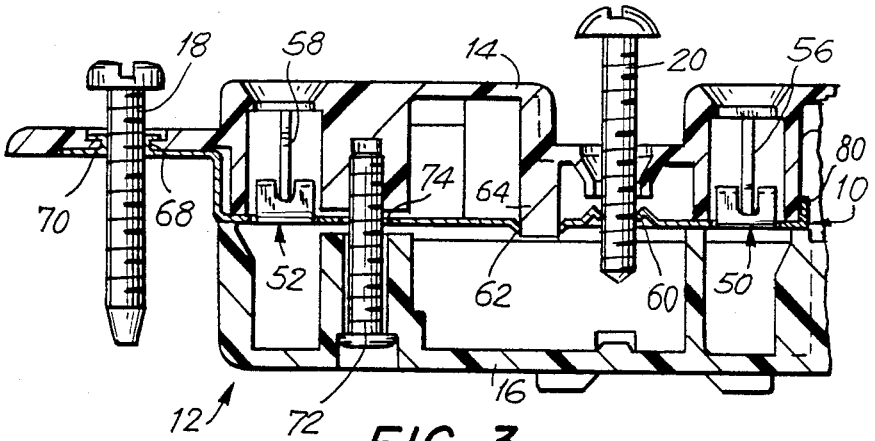
FIG. 3 is a broken-away sectional view of an assembled receptacle with the grounding strip mounted therein.

Turning now to the drawings, reference numeral 10 generally identifies a one-piece multi-function grounding strip for assembly within a duplex electrical receptacle 12 (see FIG. 3) having an upper housing part 14 and a lower housing part 16, both housing parts being constituted of an electrically insulating, e.g. plastic, material. A pair of box fastener screws 18, only one of which is shown in FIG. 3, are employed to mount the receptacle on a non-illustrated conventional junction box. A wall plate fastener screw 20, shown in FIG. 3, is employed to mount a conventional nonillustrated wall plate over the junction box. The receptacle 12 and its components are of conventional construction, except as specifically noted below. Hence, a detailed discussion of the receptacle 12, its sockets and power strips has not been provided, except to the extent that such features relate to the instant invention.

Figure 1:
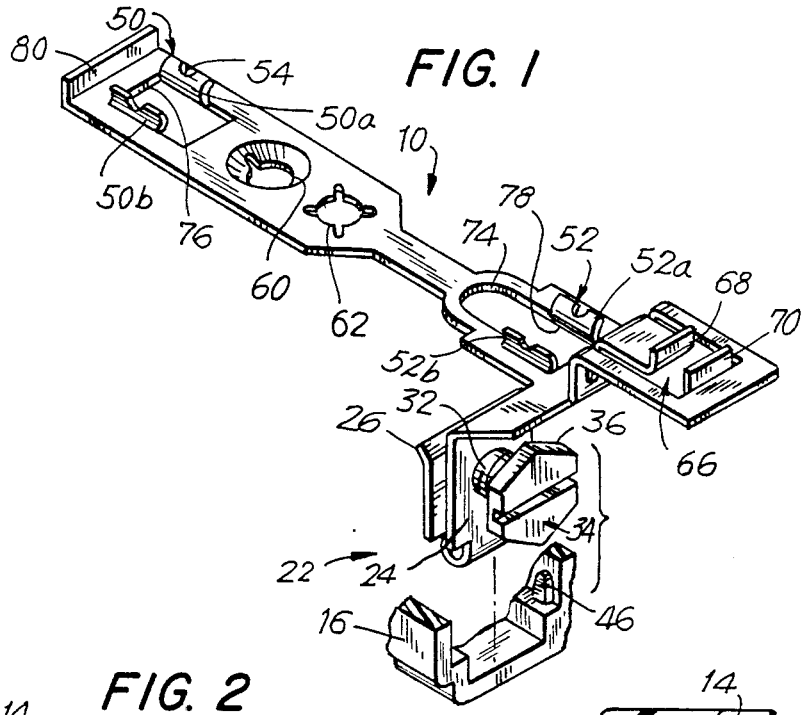
FIG. 1 is a front perspective view of a grounding strip and screw, and a broken-away perspective view of a lower housing part of a receptacle into which the strip and screw are received.
Figure 2:
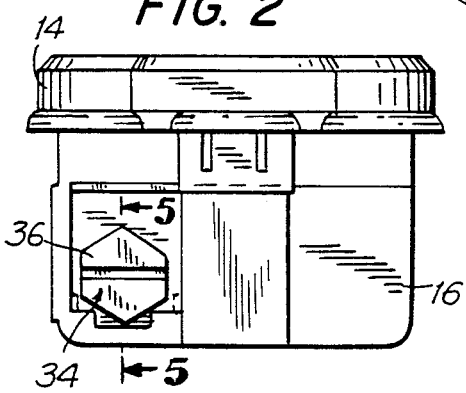
FIG. 2 is an end elevational view of an assembled receptacle showing a screw terminal.

Referring now to FIG. 1, the grounding strip 10 is constituted of a metallic material, e.g. a copper alloy, having a thickness on the order of 0.015 in. It will be recalled that a conventional grounding terminal, by contrast, has a thickness on the order of 0.030 in. minimum in order to provide sufficient "meat" so that a minimum of two threads can be formed on the strip in order to threadedly engage a grounding screw. The strip 10 according to this invention has a thickness dimension so selected as to be thin enough to allow stamped threads, known as tinamen-type threads, to be formed therethrough.

Figure 6:
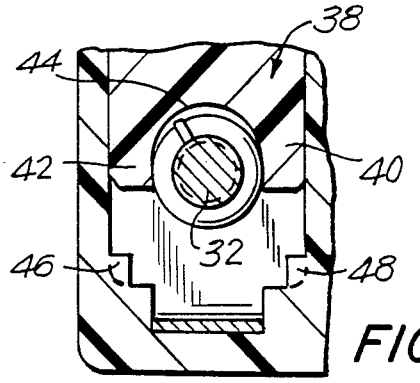
FIG. 6 is a sectional view taken on line 6—6 of FIG. 5.
Figure 5:
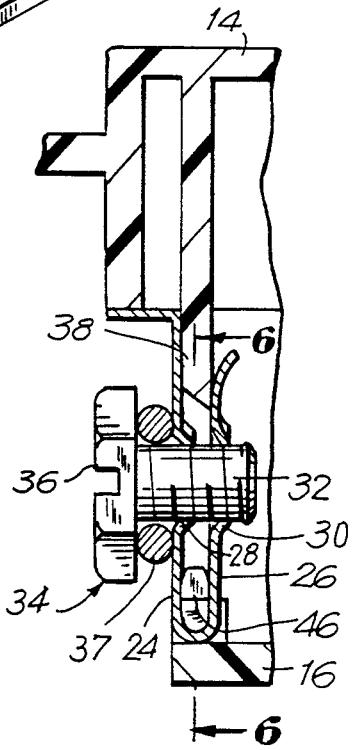
FIG. 5 is an enlarged sectional view taken on line 5—5 of FIG. 2, with a ground wire attached to the grounding screw.

The strip 10 is initially a flat, planar sheet from which various portions are cut, bent, stamped and otherwise deformed to form the various grounding functions required to be performed. Strip 10 includes a screw terminal portion 22 including two spaced-apart grounding plates 24, 26, each being stamped therethrough, as shown in FIG. 5, with a single tinamen-type screw thread 28, 30 bounding a respective hole. The holes on both plates are arranged along an axis for receiving the threaded shaft 32 of a grounding screw 34 having a head 36 under which the exposed end of a ground wire 37 is captured. The single screw threads 28, 30 threadedly engage the threaded shaft 32 at axially spaced-apart locations. As shown in FIG. 5, the upper housing part 14 has a generally planar support element or tab 38 integral therewith and extending downwardly therefrom toward the lower housing part 16. As shown in FIG. 6, the tab 38 has two arms 40, 42 bounding a downwardly-open U-shaped cutout 44. Upon assembly, the tab 38 is situated in the spacing between the plates 24, 26; the arms 40, 42 straddle the screw 34; and the cutout 44 at least partially receives the threaded shaft 32. The tab engages in surface-to-surface contact with both interior surfaces of the plates 24, 26 which face each other. The resultant combination of the plates 24, 26 sandwiching the tab 38 causes the screw terminal to be highly resistant to exterior forces tending to remove the grounding screw 34 from the strip 10. The stripping torque of one of the stamped threads, which is typically at about 10 in.-lbs., is additive to the same stripping torque of the other stamped thread so that the two stamped threads, in series and supported by the tab, will strip out at double the stripping force of one stamped thread, i.e. at about 20 in.-lbs. This stripping force is more than sufficient to pass the 14 in.-lbs. test which is currently imposed on duplex receptacles of the type described herein.

In order to further reinforce the screw terminal 22, a pair of bosses 46, 48 are formed integral with the lower housing part 16. The bosses 46, 48 project upwardly into the spacing between the plates 24, 26 at lower regions thereof, and assist the tab 38 in resisting removal of the screw 34 due to stripping forces. Also, the bosses prevent the plates 24, 26 from being bent away from the lower housing part 16, should a bending force be transmitted from the ground wire when the complete receptacle is assembled to the wall junction box.

The strip 10 also includes wiper means 50, 52, one for each outlet on the receptacle. The wiper means 50, 52 are integral with the strip 10, and wipingly contact a respective ground prong of an electrical plug to be plugged into a respective outlet. Each wiper means includes a pair of grounding contacts 50*a*, 50*b*; 52*a*, 52*b*, struck out of the strip 10 and extending upwardly therefrom. Each said contact has a curved cross-section which extends upwardly toward the grounding socket formed in each outlet. The grounding contacts 50, 52 respectively bound openings 76, 78 through which the ground plugs are respectively inserted in electromechanical wiping contact. Openings 76, 78 extend slightly past the respective pairs of contacts so that each contact pair can flex apart slightly. Each grounding contact is centrally formed with an upwardly open notch, e.g. notch 54, whose closed end is generally V-shaped. The ground prong inserted between the grounding contacts 50*a*, 50*b* is thus engaged by two separate contact faces opposing each other in order to provide for a very reliable grounding of the prong with the strip 10.

As best shown in FIG. 3, a pair of support ribs 56, 58 integral with the upper housing part 14 supportably engage a respective grounding contact. The support ribs resist distortion of the grounding contact associated therewith upon insertion of the ground prong. Hence, through repeated use, or abuse, the grounding contact according to this invention will not be deformed since it is constantly maintained in the proper position by the back-up support ribs.

Another feature of this invention resides in wall plate fastener means 60 constituting a stamped-through single screw thread of the tineman type. The thread 60, as best shown in FIG. 3, threadedly engages the wall plate threaded fastener 20, and serves to reliably mount the wall plate over the receptacle. If the wall plate is made of metal, then the wall plate is reliably grounded to the strip 10.

Figure 4:
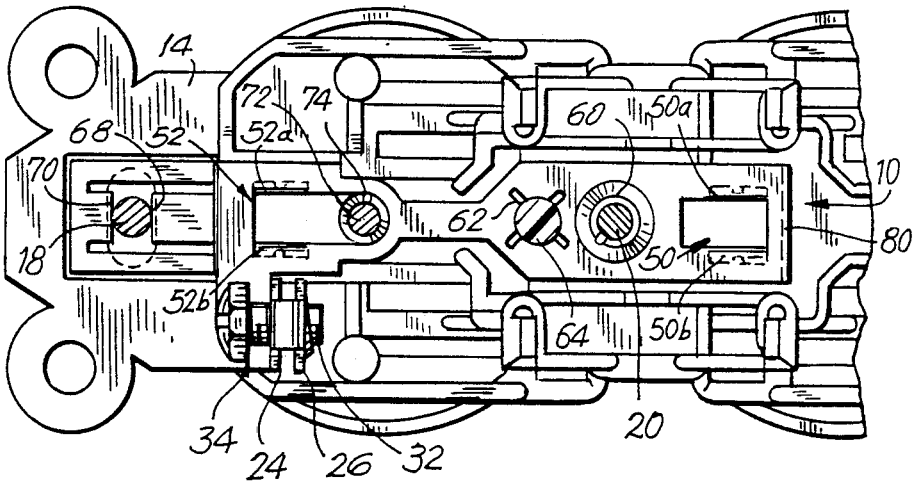
FIG. 4 is a broken-away bottom plan view showing the underside of the upper housing part of the receptacle with the grounding strip held thereon.

Another feature of this invention resides in providing means 62 integral with the strip for holding the same at a predetermined fixed position within the receptacle during assembly. The holding means 62 includes resilient walls bounding an aperture having radially outwardly-extending slits which, in FIG. 1, resemble a star-shape pattern. The resilient walls serve to resiliently and supportably engage a support post 64 (see FIGS. 3 and 4) integral with the upper housing part 14 of the receptacle. The support posts 64 extends through and is frictionally retained in, the aperture of holding means 62. This feature facilitates automatic assembly of the receptacle and effectively resists any tendency on the part of the strip 10 to shift during assembly.

Still another function performed by the strip is the grounding of the box fastener screws 18 operative for mounting the receptacle to a junction box. For that purpose, box fastener contact means 66 are formed integral with the strip, and include a pair of resilient contact surfaces or fingers 68, 70. The fingers 68, 70 are struck out of the strip and bound an opening through which the box fastener 18 is inserted. If the outlet box is made of metal, then the mere mounting of the box screw 18 automatically grounds the outlet box when the receptacle is mounted therein.

As also shown in FIG. 3, an electrically conductive stud 72 extends from lower housing part 16 to upper housing part 14 to interconnect said parts. The stud 72 passes with clearance through a corresponding clearance aperture 74 formed in the strip 10.

In the preferred embodiment of this invention, the strip 10 is constituted of a copper alloy having a thickness dimension on the order of 0.015 in., in which case, the tab 38 has a thickness on the order of 0.045 in. The various stamped-through threads correspond to No. 8-32 screw threads for the terminal screw 34 and No. 6-32 screw threads for the wall plate screw 20.

A vertical tab 80 is provided at the end of the strip to facilitate automatic feeding into an assembly machine.

It will be understood that each of the elements described above, or two or more together, also may find a useful application in other types of constructions differing from the types described above.

While the invention has been illustrated and described as embodied in a duplex electrical receptacle with one-piece multi-function grounding strip, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A one-piece, multi-function, grounding strip for assembly within an electrical receptacle of the type mounted in a junction box and covered by a wall plate, said strip comprising:

(a) wiper means integral with the strip, for wipingly contacting a ground prong of an electrical plug to be plugged into the receptacle;

(b) box fastener contact means integral with the strip, for contacting a box fastener operative for mounting the receptacle in the junction box;

(c) wall plate fastener means integral with the strip, for supportably engaging a wall plate fastener operative for mounting the wall plate over the receptacle;

(d) means integral with the strip, for holding the strip at a predetermined position within the receptacle during assembly; and (e) screw terminal means integral with the strip, for electrically grounding the strip, including a pair of spaced-apart electrically conductive grounding plates, each having a stamped-through single screw thread bounding a hole, the hole on one plate being aligned on an axis with the hole on the other plate for receiving a grounding screw through the aligned holes, the single screw threads threadedly engaging the grounding screw at spaced-apart locations and resisting axially directed forces tending to pull the grounding screw from the plates.

2. The grounding strip as recited in claim 1, wherein the screw terminal means are furnished with an electrically insulating, generally planar, support element on the receptacle and located between and engaging the grounding plates.

3. The grounding strip as recited in claim 1, wherein the screw terminal means are furnished with electrically insulating bosses extending into and supporting the grounding plates from opposite sides thereof.

4. The grounding strip as recited in claim 2, wherein the strip is constituted of an electrically conductive metallic material having a thickness dimension on the order of 1/64 of an inch, and wherein each grounding plate has said same thickness dimension as the strip, and wherein the support element has a thickness dimension on the order of 1/22 of an inch.

5. The grounding strip as recited in claim 1, wherein said wiper means includes a pair of grounding contacts struck out of the strip and extending upwardly therefrom, said grounding contacts bounding an opening through which the ground prong is inserted in electromechanical wiping contact with the grounding contacts.

6. The grounding strip as recited in claim 5, wherein each grounding contact has an upwardly open slot located centrally of a respective grounding contact to form a pair of contact faces for each grounding contact.

7. The grounding strip as recited in claim 5, wherein said wiper means are furnished with a pair of support ribs on the receptacle, each support rib supportingly engaging a respective grounding contact to resist distortion of the same upon insertion of the ground prong.

8. The grounding strip as recited in claim 1, wherein said box fastener contact means includes a pair of resilient contact surfaces struck out of the strip and bounding an opening through which the box fastener is inserted.

9. The grounding strip as recited in claim 1, wherein said wall plate fastener means includes a stamped-through single screw thread for threadedly engaging the wall plate fastener.

10. The grounding strip as recited in claim 1, wherein the holding means includes resilient walls bounding an aperture having radially outwardly-extending slits, said resilient walls resiliently and supportably engaging a support post on the receptacle, said support post extending through the aperture.

11. An improved electrical receptacle of the type mounted in a junction box and covered by a wall plate, comprising:

(A) a housing having upper and lower parts;

(B) a one-piece, multi-function, grounding strip assembled within the receptacle between the housing parts, said grounding strip including (i) prong wiper means integral with the strip, for wipingly contacting a ground prong of an electrical plug to be plugged into the receptacle, (ii) box fastener contact means integral with the strip, for contacting a box fastener operative for mounting the receptacle in the junction box, (iii) wall plate fastener means integral with the strip, for supportably engaging a wall plate fastener operative for mounting the wall plate over the receptacle, (iv) means integral with the strip, for holding the strip at a predetermined position within the receptacle during assembly, and (v) screw terminal means integral with the strip, for electrically grounding the strip, including a pair of spaced-apart electrically conductive grounding plates, each having a stamped-through single screw thread bounding a hole, the hole on one plate being aligned on an axis with the hole on the other plate for receiving a grounding screw through the aligned holes, each single screw thread threadedly engaging the grounding screw at spaced-apart locations and resisting axially directed forces tending to pull the grounding screw from the plates; and (C) an electrically insulating, generally planar, support element integral with one of the housing parts and located between and supportably engaging the grounding plates.

12. The receptacle as recited in claim 11; and further comprising electrically insulating bosses integral with the other of the housing parts and extending into and supportably engaging the grounding plates.

* * * * *